United States Patent [19]

Nickola

[11] 3,954,460

[45] May 4, 1976

[54] METHOD OF SINTER COATING METAL STRIPS WITH METALLIC POWDER USING FATTY ACID AMIDE AS A TEMPORARY ADHESIVE

[75] Inventor: Richard A. Nickola, Highland, Ind.

[73] Assignee: Inland Steel Company, Chicago, Ill.

[22] Filed: June 6, 1973

[21] Appl. No.: 367,558

Related U.S. Application Data

[63] Continuation-in-part of Ser. No. 300,171, Oct. 24, 1972, abandoned.

[52] U.S. Cl. ..... 75/208 CS; 75/200; 75/214; 75/221; 148/126; 427/192

[51] Int. Cl.[2] ..... B22F 7/00

[58] Field of Search ..... 75/22 X, 208 R, 208 CS, 75/214, 200; 117/100 M, 22; 148/126

[56] References Cited

UNITED STATES PATENTS

| | | | |
|---|---|---|---|
| 2,582,744 | 1/1952 | Brennan | 75/208 |
| 2,694,647 | 11/1954 | Cole | 117/22 |
| 3,024,128 | 3/1962 | Dawson | 117/22 |
| 3,312,546 | 4/1967 | Mayer et al. | 75/208 R |
| 3,364,057 | 1/1968 | Jackson | 117/22 X |
| 3,449,146 | 6/1969 | Dawson | 117/22 X |
| 3,565,663 | 2/1971 | Costelloe et al. | 117/22 X |
| 3,755,090 | 8/1973 | Jackson et al. | 75/208 CS X |

FOREIGN PATENTS OR APPLICATIONS

| | | | |
|---|---|---|---|
| 748,381 | 12/1966 | Canada | 75/208 CS |

*Primary Examiner*—Benjamin R. Padgett
*Assistant Examiner*—R. E. Schafer
*Attorney, Agent, or Firm*—Hibben, Noyes & Bicknell

[57] ABSTRACT

A method of providing sintered and diffused metal coatings of finely divided metallic material on a metal base, such as a steel strip or panel, by forming a molten film of one or more higher fatty acid amides having a carbon chain length from about 8 to 18 carbon atoms on a clean surface of the metal base which is preferably heated to a temperature above the melting point of the fatty acid amide film, applying uniformly on the molten amide film an amount of a finely divided metallic material, such as powdered Monel metal or nickel, in excess of that which settles into the film and is held thereby and removing the excess metal powder after the amide film has solidified, and heat treating the metal base having the coating of amide and metal powder thereon in a non-oxidizing reducing atmosphere at a temperature and for a period sufficient to effect bonding of said finely divided metallic material with each other and with said metal base to form a uniform firmly adherent metal coating. The metal base with the finely divided metallic material on the surface thereof can be compacted by rolling, either before or after heat treating, and thereafter annealed as required.

The resulting coatings are porous coatings having a large surface area where no compacting is effected and are dense impervious coatings when compacted to effect a 60 percent reduction in the thickness of the base.

13 Claims, 2 Drawing Figures

METHOD OF SINTER COATING METAL STRIPS WITH METALLIC POWDER USING FATTY ACID AMIDE AS A TEMPORARY ADHESIVE

This application is a continuation-in-part of copending U.S. Pat. application Ser. No. 300,171, filed Oct. 24, 1972 now abandoned.

The present invention relates generally to forming a coating of finely divided metallic material on a ferrous metal strip or sheet, and more particularly to a method of forming on an endless steel strip or on a steel sheet a sinter and/or diffusion metallic coating of finely divided metallic material.

Sinter and/or diffusion coatings of finely divided metallic material have heretofore been applied to ferrous metal strips by various methods to improve the resistance of the ferrous metal to oxidation, corrosion and similar stresses, to improve appearance, or to impart other useful properties to the surface of a ferrous metal strip. For example, coatings of finely divided protective metal have been applied to the surface of a ferrous metal strip as a liquid slurry and thereafter heated to form a sinter and/or diffusion coating of the protective metal on the ferrous metal strip. However, it is difficult to maintain the finely divided metal particles uniformly distributed in a slurry so that a uniform coating is formed on the ferrous metal surface.

It has also been proposed to form a sinter and/or diffusion coating on the ferrous metal base by applying an adhesive film of a non-volatile material which serves as a carrier and retainer for particles of metallic material which are dusted thereon and retained until heated sufficiently to effect sintering and/or diffusion of the particles into the ferrous metal base (U.S. Pat. No. 2,694,647). A film coating of a volatile material has also been used as the carrier or adhesive layer for protective metal particles which are dusted thereon, compacted and heated sufficiently to form a diffusion coating (U.S. Pat. No. 3,312,546).

When a sinter and/or diffusion coating of a finely divided metallic material, such as nickel, Monel or the like, is provided by any of the previously developed procedures, the metal coating formed after heating to effect sintering and/or diffusion may gradually lose its mechanical strength and, particularly where a relatively thick protective metallic coating is provided using a volatile material as the carrier, the coating is frequently defective because distortions and bulges are formed in the sinter and/or diffusion coating due to the entrapment of gases between the base metal and the compacted finely divided metal during the heating step.

It is therefore an object of the present invention to provide an improved process of forming on a ferrous metal base a sinter and/or diffusion coating of a finely divided metallic material which is ductile, has good mechanical strength, and is free of distortions and bulges over a wide range of coating thickness.

It is also an object of the present invention to provide an improved process adapted for coating an endless steel strip with finely divided metallic material to provide a substantially uniform sinter and/or diffusion coating which is ductile, has good mechanical strength, and is free of distortions and bulges over a wide range of coating thickness.

It is a further object of the present invention to provide an improved process of forming an impervious metal coating on a ferrous metal base which is ductile, has good mechanical strength, and is free of distortions and bulges over a wide range of coating thickness.

It is still another object of the present invention to provide an improved process of forming a porous metal coating on a ferrous metal base which is ductile, has good mechanical strength, and is free of distortions and bulges over a wide range of coating thickness.

Other objects of the present invention will be apparent to those skilled in the art from the accompanying detailed description and claims to follow, when read in conjuction with the accompanying drawing wherein;

Figure 1:
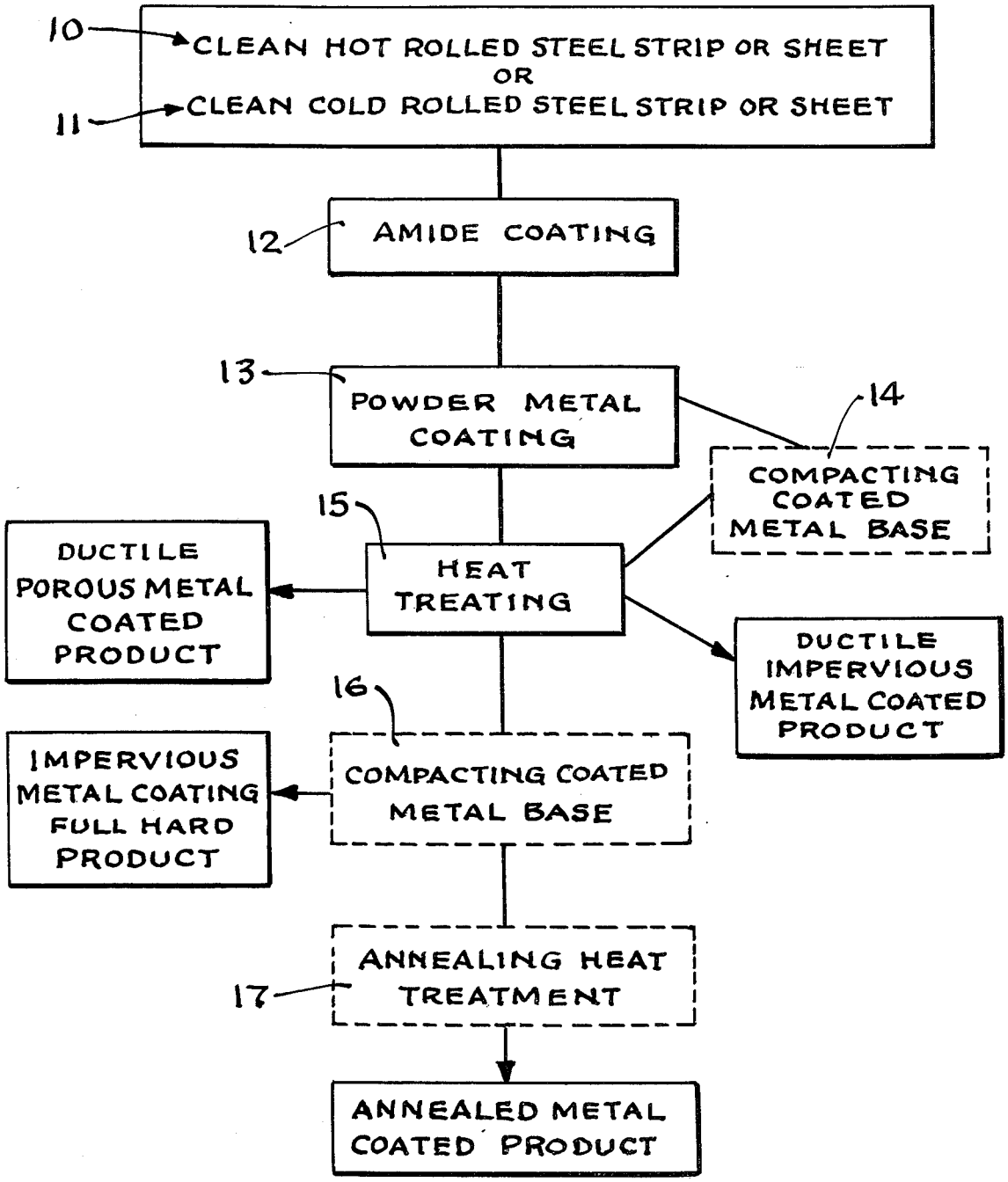
FIG. 1 is a flow diagram of the steps of the present invention with optional and alternate steps shown within dotted lines.

In achieving one or more of the objects of the present invention and with reference to the flow diagram of FIG. 1 a ferrous metal base, such as a precleaned hot rolled steel strip or sheet 10 or a precleaned cold rolled steel strip or sheet 11 is coated at 12 on one or both broad lateral surfaces with a film or coating of one or more higher fatty acid amides having the properties described herein. The strip 10 or 11, free of surface contamination such as oxides, rolling oils and the like, is preferably heated to a temperature of at least about 150° F and at least above the melting point of the fatty acid amide material prior to applying the amide film thereto. While the fatty acid amide material is above its melting point a layer of finely divided metallic material capable of forming a sinter and/or diffusion coating when heated to a temperature below the melting point of the ferrous metal base is dusted or otherwise applied at 13 to the film of fatty amide to provide a uniform suspension of finely divided metallic material in the film before the amide film solidifies. After solidification, the composite layer of fatty acid amide with the finely divided metallic material held therein, if desired, is compacted at 14 to effect a reduction in the thickness of the ferrous metal base in any convention cold reduction apparatus, such as a cold reducing mill, and the ferrous metal base with the composite coating is heat treated at 15 to a temperature sufficient to effect volatilization of the fatty acid amide material, the sintering together or bonding of the finely divided metal particles to each other and the bonding of the particles with the base. The temperature to which the base is heated to effect the required volatization, sintering and bonding mainly depends on the properties of the metal particle used, but is usually between about 1750°F and 1900°F. Even where a compacting step 14 which effects a 60% reduction in the thickness of the ferrous metal base is performed, the amide coating is readily volatilized and completely removed from the surface of the ferrous metal base during the initial heat treating of the ferrous metal base without entrapping gases between the base metal and the layer of metallic particles. The fatty acid amide material of the present invention in addition to being removed by being volatilized is also decomposed well below the sintering and/or diffusion temperatures of the finely divided protective metals without leaving a solid residue.

The sinter coating formed where there has been no compacting prior to heat treating sufficient to effect substantial reduction in the thickness of the ferrous metal base will be a porous coating in which the particles of finely divided metal have been sufficiently bonded to each other and to the surface of the ferrous metal base and which form a unitary, ductile, firmly adherent coating having a large surface area. If a more compact coating or an impervious coating is desired, the porous coating which has not previously been compacted or the coating which has been only slightly compacted prior to heating to a sintering or bonding temperature which effects removal of the volatile amide carrier and agglomeration of the metal particles can be subjected to one or more cold reduction step 16 and annealing step 17 to provide coating having any desired porosity or density.

The fatty acid amides which are useful in the process of the present invention are amides of the higher fatty acids, such as the saturated and unsaturated fatty acids having a carbon chain length of from about 8 to 18 carbon atoms, which exhibits a wax-like solid consistency at room temperature and melt between about 150°F and 230°F. These fatty acid amides are thermally decomposed above temperatures of about 345°F and have a flash point ranging from about 345°F to 445°F and a fire point ranging from 365°F to 485°F. The highly purified oleamides, octadecanamide and 9-octadecanamide, have been found particularly suitable for use in the present invention when used alone or in combination with small amounts of tetradecanamide, hexadecanamide and heptadecanamide.

The film of fatty acid amide material can be applied to one or both sides of a ferrous metal base, such as a steel strip, by roll coating, electrostatic spray coating, immersion coating or other suitable coating means, so as to provide a coating having a substantially uniform thickness. An air knife, doctor blade or other means can be used to control the thickness of the amide film. The coating weight of the film of amide material applied to the ferrous metal base controls the final metallic coating thickness, as will be described hereinafter, and generally rangès between about 0.1 mg./cm.$^2$ and 1.0 mg./cm$^2$.

A wide range of sinter and/or diffusion coating thicknesses can be provided with the process of the present invention. When providing an impervious coating the final thickness thereof generally ranges between about 0.2 and 2.0 mils, and a porous sinter coating will range in thickness between about 1.0 and 10 mils. The porous coatings can be transformed into substantially thinner impervious coatings having a thickness as small as 0.1 mils by compacting the porous coating and base following the initial heat treating step.

Among the metallic coatings which can be applied in accordance with the present invention are finely divided nickel, Monel, cupro-nickel, dura-nickel, bronze, brass, aluminum, aluminum alloys, chromium and chromium alloys, and like metal or metal alloys. Generally, the metals and alloys which present some difficulty when applied by hot dip coating and which are capable of forming a sinter coating at a temperature below the melting point of ferrous metals can be applied by the process of the present invention. The particle size of the finely divided metallic material can range between about 100 mesh (U.S. Std.) and 325 mesh (U.S. Std.) with a particle size of −200 mesh (U.S. Std.) being preferred.

The temperature and duration of the heat treatment step employed will depend in part on the type of coating desired. Thus, if a sinter coating of Monel or nickel is desired with only minimal diffusion of the coating material into the ferrous metal base, the ferrous metal article having a composite coating of the finely divided metal and amide thereon can be heated in a conventional manner to an elevated temperature of between about 1750°F and 1900°F for a relatively short period. If a strip in the form of a coil is being heat treated batch-wise to provide a sinter coating, heating at 1750°F for 30 minutes or 1-hour in an open-coil annealing furnace is sufficient to form a bond between the particles of the metal and the ferrous metal coating without causing a substantial proportion of the finely divided metallic material to diffuse into the ferrous metal base. A ductile surface coating is formed, which can be either porous or impervious depending on whether substantial compacting of the base and coating is carried out, and the coating will have the composition of the finely divided metallic particles with only a relatively thin intermetallic layer at the interface with the ferrous metal base. The formation of a high quality inpervious ductile sinter coatingg with a thin intermetallic layer is greatly facilitated by compacting to a relatively high degree prior to heat treating.

Use of the improved higher fatty acid amide carriers to provide an impervious metal coating permits compacting before heat treating to a substantially higher degree without causing bulges or other irregularities in the sinter and/or diffusion coating than has heretofore been possible. Thus, the ferrous metal base material having the composite layer of fatty acid amide and finely divided protective metal on one or both surfaces thereof can be reduced in thickness as much as 60% or more by cold rolling without impairing the quality of the final sinter and/or diffusion coating. If desired, the reduction in thickness can be effected in one or more cold rolling operations before heating to effect bonding (i.e. sintering and/or diffusion). If preferred, partial reduction can be effected followed by heating to sintering and/or diffusion temperatures and thereafter repeating the cold rolling and heating cycle one or more times. The initial heat treating step and the reheating steps after compacting, in addition to improving sintering and/or diffusion, also anneal the cold reduced steel strip and the sinter and/or diffusion coating on the strip.

An impervious diffusion and/or sinter coating can also be provided where minimal or no compacting of the ferrous metal base is employed by prolonging the heat treatment to effect diffusion of a substantial portion of the finely divided material into the ferrous metal base; thereby forming an impervious intermetallic layer at the interface between the ferrous metal base and the metal powder coating. The resulting coating can have a substantial portion thereof comprised of an alloy of ferrous metal and the powdered protective metal with only the surface having the composition of the finely divided metallic material. And, if the coating and ferrous metal base are heated at an elevated temperature for a sufficiently long period, the surface coating will be comprised entirely of an alloy of ferrous metal and the finely divided metallic material.

When forming a porous metal coating, it is neither necessary nor advisable to compact the composite layer of fatty acid amide material and powdered metallic material before heating to a sintering temperature. And, in the embodiment of the present invention where no compacting step is employed before the heat treatment step, it is possible to form coatings ranging from very porous coatings to very dense impervious coatings by applying various degrees of compacting to the porous ductile coating after heat treating to effect sintering and removal of the amide-powder metal composite layer. Impervious metal coatings are formed from the porous coatings when the ferrous metal base is reduced in thickness about 25%, as by cold rolling, leaving the base in a partially hardened state. If the base is reduced in thickness by 60%, the porous coating is transformed into a very dense impervious coating with the base in the full-hard condition. The base and coating can be annealed in the same manner as any cold rolled steel sheet to provide the base and the coating with the desired physical properties without adversely affecting the sinter and/or diffusion coating.

To further illustrate the present invention the following specific examples are given without, however, limiting the invention to the particular material, conditions or apparatus used in the examples.

EXAMPLE 1

A 21 gauge cold rolled 3 × 5 inch mild steel panel (AISI-1008 steel) was degreased in a conventional alkaline cleaning bath, pickled in an aqueous 15% hydrochloric acid bath at a temperature of 150° F, rinsed in water and dried. The clean panel was preheated to 200° F and roll coated with 0.3 mg./cm$^2$ of a fatty acid amide material heated to 200° F. The amide material on a weight basis consists of about 80% 9-octadecanamide, 10% hexadecanamide, 5% tetradecanamide, 4% 9-12 octadecadienamide and 1% heptadecanamide and has a melting point of 162° F, a flash point of 410°F and a fire point of 455°F. Finely divided Monel metal (−200 mesh, U.S. Std.) was applied uniformly to the fluid amide coating by dusting an excess of the powdered Monel metal through a fine sieve so that the higher density powdered Monel metal settles into the molten amide film with the powdered metal being suspended in the body of the film and substantially saturating the film with powdered metal in addition to having powdered metal held on the surface of the amide film. The excess powdered metal which was not retained by the amide film was removed by inverting the panel. Thereafter, the coated panel was cooled to room temperature. The finely divided metallic coating was compacted by cold rolling in 3 passes to effect a 60% reduction in the thickness of the panel. The panel was then heat treated for 30 minutes in a chamber having a temperature of 1750°F with a reducing non-oxidizing atmosphere composed of 15% hydrogen and 85% nitrogen and a dew point of −35°F. The Monel metal coating formed had a very thin diffusion inner layer and an outer sinter layer having a thickness of about 0.8 mils, had a bright appearance, was adherent to the ferrous metal base, and was ductile and without bulges.

EXAMPLE 2

An 18 gauge cold rolled 3 × 5 inch mild steel panel (AISI-1008 steel) was cleaned as in Example 1, coated with the same film of the higher fatty acid amide material and dusted with finely divided Monel metal (−200 mesh U.S. Std.) in the same manner as in Example 1. The coating was compacted by cold rolling in a single pass to effect an 8% reduction in the thickness of the panel. The panel was heated at a temperature of 1750°F for 30 minutes in a reducing non-oxidizing atmosphere having the composition set forth in Example 1. Thereafter, the panel was recycled through a cold rolling mill to effect a 30% reduction in the thickness of the panel in one pass and reheated at 1750°F for 30 minutes in the same protective atmosphere. The coating formed was substantially the same as in Example 1 with the sinter layer having a thickness of about 0.8 mils, was bright, adherent. bulge-free and ductile as evidenced by Bend tests (0-T, 1-T and 3-T).

Finely divided metallic nickel (−200 mesh, U.S. Std.) was substituted in Example 1 and Example 2 for the powdered Monel metal and the same processing steps were performed. In each instance a protective coating of metallic nickel was formed on the panels which had the same substantial structure and thickness as in the foregoing specific examples.

EXAMPLE 3

An 18 gauge (0.050 inch) cold rolled 3 × 5 inch mild steel panel (AISI-1008 steel) was degreased in a conventional alkaline cleaning bath, pickled in an aqueous 15% hydrochloric acid bath at a temperature of 150°F, rinsed in water and dried. The clean panel was preheated to 200°F and roll coated with 0.3 mg./cm$^2$ of a fatty acid amide material heated to 200°F. The amide material on a weight basis consists of about 80% 9-octadecanamide, 10% hexadecanamide, 5% tetradecanamide, 4% 9-12 octadecadienamide and 1% heptadecanamide and has a melting point of 162°F, a flash point of 410° F and a fire point of 455°F. Finely divided Monel metal (−200 mesh, U.S. Std.) was applied uniformly to the fluid amide coating by dusting an excess of the powdered Monel metal through a fine sieve so that the higher density powdered Monel metal settles into the molten amide film with the powdered metal being suspended in the body of the film and substantially saturating the film with powdered metal in addition to having powdered metal held on the surface of the amide film. The excess powdered metal which was not retained by the amide film was removed by inverting the panel. Thereafter, the coated panel was cooled to room temperature. The panel was then heated for 8 minutes to a temperature of 1750°F in reducing non-oxidizing atmosphere composed of 15% hydrogen and 85% nitrogen and having a dew point of −35% F. The Monel metal coating formed had a very thin dffusion inner layer and a sinter layer having a thickness of about 4.6 mils, exhibited a dull gray appearance, was adherent to the ferrous metal base and was ductile, as evidenced by the coated strip being able to be bent back upon itself without having the coating flake.

EXAMPLE 4

An 18 gauge cold rolled 3 × 5 inch mild steel panel (AISI-1008 steel) was cleaned as in Example 3, coated with a same film of the higher fatty acid amide material and dusted with finely divided Monel metal (−200 mesh U.S. Std.) in the same manner as in Example 3. Without compacting the panel was heated at a temperature of 1750° F for 8 minutes in the reducing non-oxidizing atmosphere as described in Example 3, and the panel was recycled through a cold rolling mill (4 passes) to effect a 47% reduction in the thickness of the panel, followed by annealing at 1250° F for 8-hours in the same protective atmosphere. The impervious coating formed was substantially the same as in Example 1 with the sinter layer having a thickness of about 0.6 mils. The coating had a bright appearance, was bulge-free and ductile, as evidenced by Bend tests (0-T, 1-T and 3-T).

Figure 2:
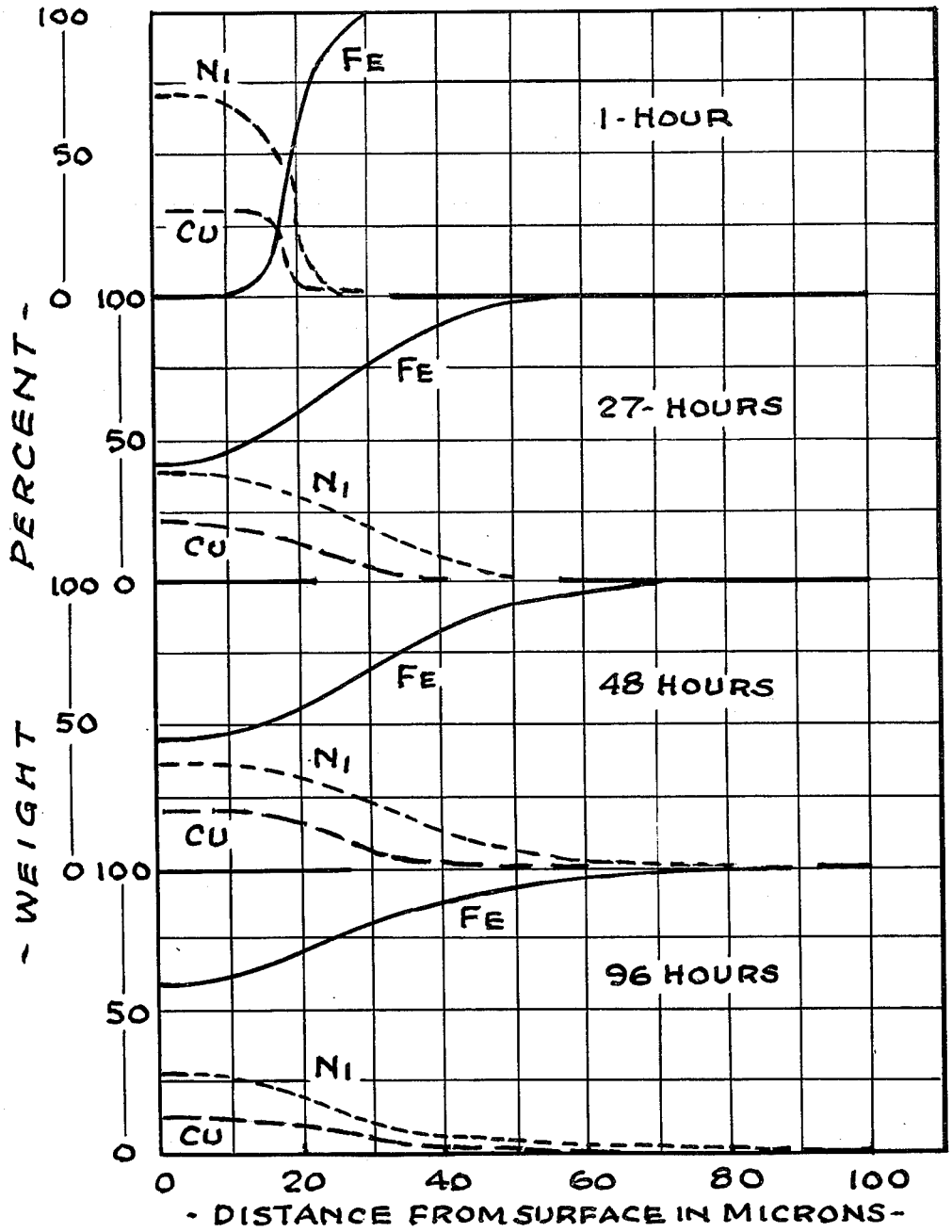
FIG. 2 shows graphs indicating the weight percent composition of a coating of Monel metal on a ferrous metal base applied according to the present invention at increasing distance from the surface of the base after the indicated period of heating.

From the graphs shown in FIG. 2 it is apparent that after a panel coated with Monel in accordance with Example 1 was heat treated for one hour at 1750°F, a major portion of the coating was comprised of sinter material having the same composition as Monel with only a minor amount in the form of ferrous alloy. After continuing the heat treatment for 27 hours and longer, however, diffusion coatings were formed. The depth or thickness of the ferrous alloy diffusion coating formed increased as the heat treatment period was prolonged. The concentration of the applied particulate metal found in the surface portion of the diffusion coating varied inversely with the duration of the heat treatment. Thus, after heat treating the coated panel for 27 hours, the weight percent concentration of nickel in the surface of the coating was about equal to the weight percent concentrate of iron, whereas after heat treating the coated panel for 96 hours the weight percent concentrate of nickel in the surface of the coating was only about half that of iron. Thus, by controlling the length of the diffusion heat treatment, the depth of the ferrous alloy coating and the composition of the ferrous alloy coating at the surface of the panel or strip can be controlled within relatively wide limits.

While the several specific examples have been directed to the embodiment of the invention in which steel panels have been processed batchwise, it should be understood that the process of the present invention can be used to continuously apply a sinter or diffusion coating to an endless steel strip by means of continuous-in-line apparatus, such as conventional continuous annealing or normalizing apparatus. When producing a sinter coating using conventional continuous-annealing line apparatus, the steel strip having the amide surface film saturated with powdered metal, such as Monel, is continuously passed through a heating zone with the temperature thereof preferably held at about 1900°F and maintained in a holding zone at a temperature of about 1800°F for a period of about 20 seconds to effect the bonding of the particles of metal to each other and to the strip, after which the sinter coated strip is cooled stepwise, as in a continuous annealing process. While the strip is being heat treated and until the strip is cooled below about 300°F, the strip and coating are maintained under the same protective atmosphere as used in the batch process described in the specific examples.

It will be apparent to those skilled in the art that the panel or the continuous strip of metal need not be ferrous metal and that other metals can be coated in accordance with the process of the present invention. For example, metals such as cobalt, titanium, molybdenum, and nickel and alloys thereof in the form panels and continuous srips can be provided with a protective or decorative coating using the process of the present invention. Also, a ferrous metal base can have the surface thereof coated in any manner desired with a metal or alloy of the foregoing type prior to being coated in accordance with the process of the present invention without departing from the scope of the present invention.

I claim:

1. A process of forming on a metal strip an adherent coating of a finely divided metallic material which forms a sinter coating at a temperature below the melting point of the metal strip comprising; applying to a clean surface of said metal strip a film of a fatty acid amide having a carbon chain length between about 8 and 18 carbon atoms and a melting point between about 150°F and 270°F, depositing a finely divided metallic material on said film to effect forming a suspension of said finely divided metallic material in said film while said film remains molten, and heating said metal strip in a reducing non-oxidizing atmosphere at a temperature which effects bonding between said finely divided metallic material and said metal strip to form an adherent ductile metallic coating on said strip.

2. A process as in claim 1, wherein said fatty acid amide is selected from a group of fatty acid amides consisting of octanamide, decanamide, dodecanamide, tetradecanamide, pentadecanamide, hexadecanamide, heptadecanamide, octadecanamide, 9-octadecanamide, and 9-12 octadecadienamide.

3. A process as in claim 2, wherein said film is comprised of at least about 80% by weight 9-octadecanamide.

4. A process as in claim 1, wherein said finely divided metallic material is deposited on said film in an amount sufficient to form a substantially uniform saturated suspension of said finely divided metallic material in said film.

5. A process as in claim 1, wherein said metal strip and finely divided metallic material are subjected to compacting which effects a reduction in the thickness of said strip by at least about 8 percent before heating to effect said bonding.

6. A process as in claim 5, wherein said metal strip is reduced in thickness by said compacting between about 30 and 60 percent.

7. A process as in claim 1, wherein said strip after said heating at a temperature which effects said bonding is compacted to reduce the thickness of said strip and the porosity of said coating.

8. A process as in claim 7, wherein said metal strip when compacted is reduced in thickness after said heating between about 25 and 60 percent.

9. A process as in claim 8, wherein said strip is subjected to reheating in a said non-oxidizing atmosphere at a temperature at least about 1250°F to effect annealing of said base.

10. A process as in claim 1, wherein said strip is heated to at least the melting point of said amide before applying said film of amide to said strip.

11. A process as in claim 1, wherein said strip is a ferrous metal and said temperature to which said metal strip is heated to effect said bonding is between about 1750°F and 1900°F,

12. A process as in claim 1, wherein said metal strip is heated in said atmosphere for a period sufficient to effect diffusion of a major proportion of said finely divided metallic material into said strip.

13. A process as in claim 1, wherein said finely divided metallic material is selected from the group consisting of Monel, nickel, cupro-nickel, dura-nickel, bronze, brass, aluminum, aluminum alloys, chromium and chromium alloys.

* * * * *